United States Patent [19]

Lok

[11] Patent Number: 5,044,352

[45] Date of Patent: Sep. 3, 1991

[54] LARGE-BURNER STOVE WITH RECESSED BURNER WELL

[76] Inventor: Yuk L. Lok, 33-39 73rd St., Queens, N.Y. 11372

[21] Appl. No.: 626,959

[22] Filed: Dec. 12, 1990

Related U.S. Application Data

[63] Continuation-in-part of Ser. No. 480,913, Feb. 16, 1990, Pat. No. 4,984,558.

[51] Int. Cl.[5] ..... F24C 3/00

[52] U.S. Cl. ..... 126/39 R; 126/39 H

[58] Field of Search ..... 126/39 R, 39 H, 39 K, 126/214 R, 214 A

[56] References Cited

U.S. PATENT DOCUMENTS

| | | | |
|---|---|---|---|
| 38,776 | 6/1863 | Verbeck et al. . | |
| 847,378 | 3/1907 | Sloan . | |
| 2,085,511 | 6/1937 | Ross et al. | 126/39 H |
| 2,566,440 | 9/1951 | Beyhon | 126/39 H |
| 4,406,396 | 9/1983 | Habegger . | |

FOREIGN PATENT DOCUMENTS

| | | |
|---|---|---|
| 2475697 | 8/1981 | France . |
| 341555 | 1/1931 | United Kingdom . |

*Primary Examiner*—Carroll B. Dority
*Attorney, Agent, or Firm*—Leighton K. Chong

[57] ABSTRACT

A stove suitable for large-burner cooking with a high heat flame has an enclosed stove casing with an upper cooking surface, a hollow interior, and a burner well recessed into the interior of the casing. A large burner is positioned in the burner well, and a cooking vessel can be placed over the well so as to close the burner flame off from the outside. The burner well has an annular rim which can support a wok or other rounded-bottom cooking vessel. The high heat exhaust from the burner is trapped in the well and entrained by natural convection into a duct member to a duct casing at a rear side of the stove which has baffles forming a labyrinthine channel for mixing cold air with the hot exhaust air from the large burner. The stove includes a catch basin member positionable in the interior of the burner well for catching any spillage or debris. The stove casing has a window formed in its front panel for allowing the stove user to visually check the burner flame. Further features include a recessed burner plate positionable in the well over the burner for allowing cooking with other types of cooking vessels, and a grill positionable over the annular rim of the stove and a deflector unit below for open-flame cooking when the wok is not used.

17 Claims, 6 Drawing Sheets

LARGE-BURNER STOVE WITH RECESSED BURNER WELL

This is a continuation-in-part of my U.S. patent application Ser. No. 07/480,913, filed Feb. 16, 1990, entitled "Large Burner Stove With High Heat Exhaust Ducting", which is issuing as U.S. Pat. No. 4,984,558.

FIELD OF THE INVENTION

This invention generally relates to a stove for cooking, and particularly to one having a large burner adapted for multiple styles of cooking with a high heat flame.

BACKGROUND ART

Industrial stoves, e.g. as used in restaurants and institutional kitchens, often have one or more large burner units that generate a high amount of heat and smoke that must be exhausted from the cooking area. Equipment typically used to handle large volumes of exhaust include large fans that pull heated and smoke-filled air from around the stove cooking area into a duct system that directs the high heat exhaust out through an exit vent or a chimney. In such conventional large-burner stoves, the burners provide their gas-fired flames at the stove surface under the pots, frying pans, and other cooking vessels. In the cooking of Oriental foods, a large-diameter wok is typically seated on a support or collar while a large burner provides an exposed flame often at full gas volume.

The exposed flames of large-burner stoves generate high amounts of heat that must be ducted forcefully away from the cook. Measures must be taken to handle the high heat of the exhaust. For example, the high heat exhaust must be ducted into a chimney lined with refractory material, or must be forcefully mixed with cool air to reduce its temperature to manageable levels. The required high-capacity fan and duct system is a large equipment that has a high cost and takes up a large volume of space. This requirement makes large-burner stoves costly, unsuitable and/or unsafe for common use in the home.

SUMMARY OF THE INVENTION

It is therefore a principal object of the invention to provide a large-burner stove that has a simple and inexpensive structure for handling multiple styles of cooking with a high heat flame. It is also desired to have a large-burner stove which is suitable for use in the home, and which does not require a high-capacity fan and duct system to handle the exhaust.

In accordance with the present invention, a stove suitable for large-burner cooking using a high heat flame comprises an enclosed stove casing having walls defining a horizontal upper surface used as a cooking surface and a hollow interior, a burner well extending into the interior of said stove casing and having an upper annular rim at said horizontal upper surface, said annular rim defining a support for a cooking vessel, a burner recessed at an interior position in said well in the interior of said casing which provides a flame to a bottom portion of a cooking vessel used thereon, ducting means including a first duct member positioned at a rear portion of said stove casing remote from said burner well and a second duct member having an opening positioned adjacent said burner in said well and another opening communicating into said first duct member for conveying high heat exhaust from said burner into said first duct member at said rear portion of said stove casing, and a catch basin member positionable in the interior of said burner well having annular walls defining a central opening for fitting around said burner and a surrounding retention area for catching any spillage or debris falling from a cooking vessel used thereon.

In the preferred embodiments of the invention, the burner well is adapted to support a wok or other rounded-bottom cooking vessel on its upper annular rim, and a large burner is recessed in the well to provide a high-heat flame to the bottom of the wok. The well is lined with refractory material to insulate the heat in the well. The catch basin member has an opening formed through a front portion of its walls, and the stove casing has a window formed in its front panel aligned with the opening, for allowing the stove user to visually check the burner flame by viewing through the window. Further features of the invention include a recessed burner plate which is positionable in the well over the burner for allowing cooking with other types of cooking vessels, and a grill which is positionable over the upper annular rim and a deflector unit positionable below the grill and over the burner for open-flame cooking when the wok is not used.

Other objects, features and advantages of the present invention will be apparent from the following description of the preferred embodiments with reference to the drawings, of which:

DETAILED DESCRIPTION OF THE INVENTION

In the following description, the invention is described with reference to a particular embodiment of a large-burner stove suitable for multiple types of cooking using a high heat flame. The stove has a large burner recessed in a well in the interior of a stove casing, so that the flame of the burner is substantially confined within the well, and the high heat exhaust from around the recessed burner is directed through a duct in the interior of the stove casing to an exhaust moderator chimney located at a rear portion of the stove casing.

The preferred embodiment is a unit sized for home cooking and has one large burner which is used for wok cooking and two smaller conventional burners. However, it is to be understood that the principles of the invention are equally applicable to multiple large-burner arrangements, as well as to industrial stoves for use in restaurants and institutional cooking.

Figure 1:
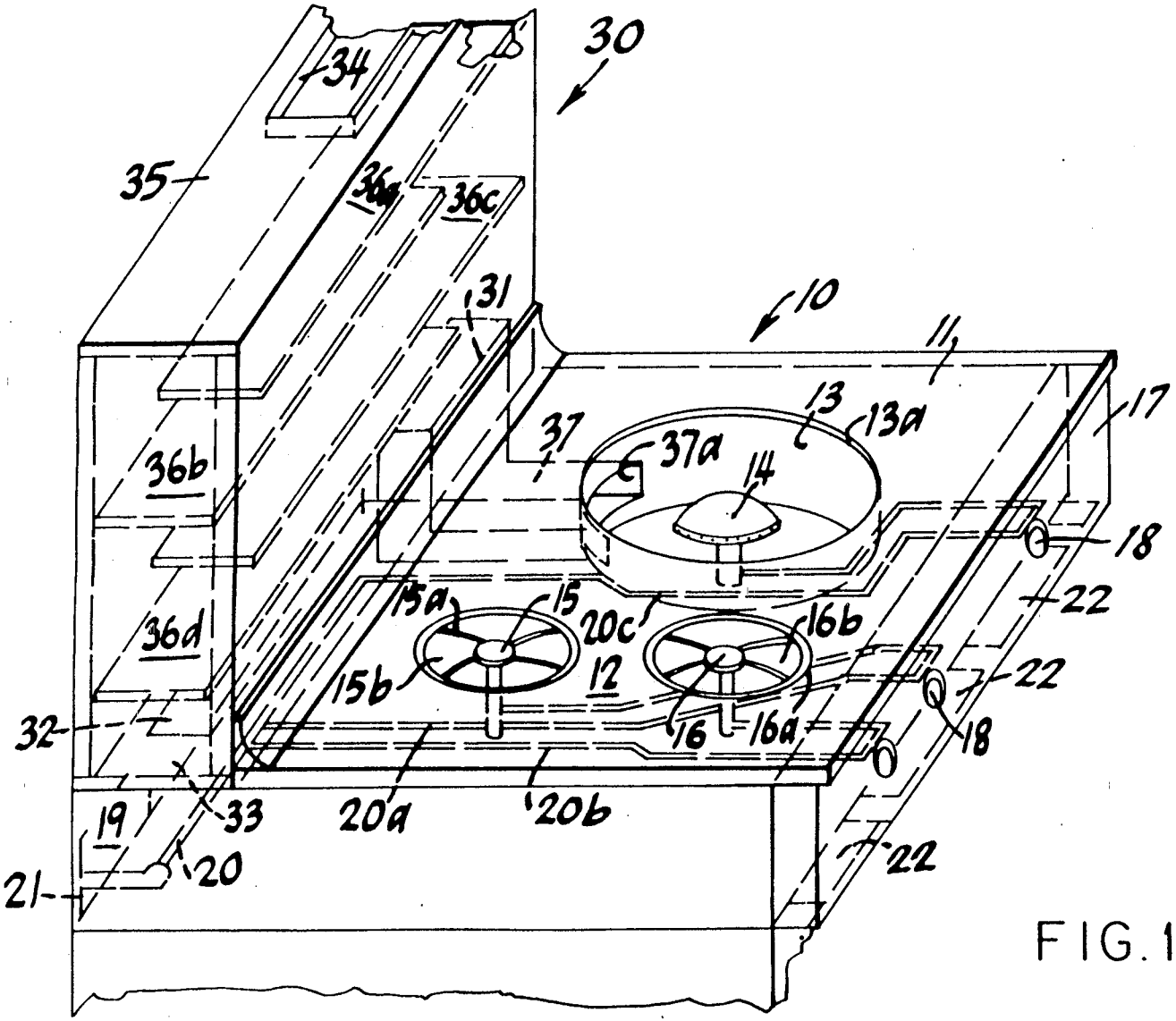
FIG. 1 is a perspective view of one embodiment of a stove suitable for large-burner cooking generating high heat exhaust, in accordance with the invention, having one large burner recessed in a well and two conventional small stove-top burners.
Figure 2:
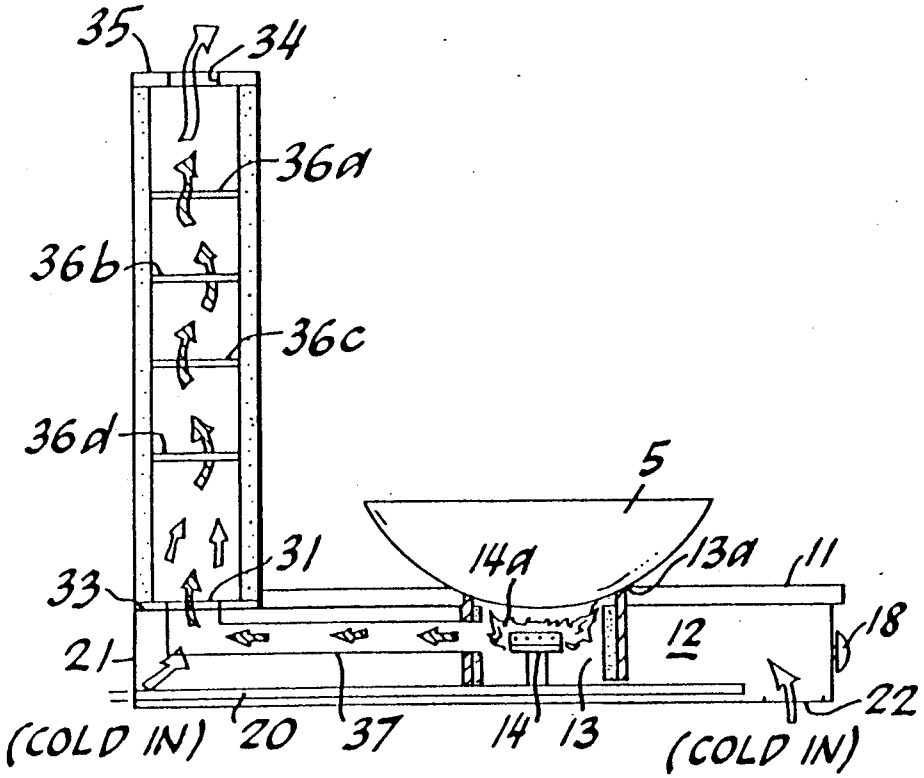
FIG. 2 is a side sectional view of the stove of FIG. 1 showing a section through the large burner, burner well, and rear duct casing.

Referring to FIG. 1, a stove embodiment in accordance with the invention has a stove casing 10 having sheel metal walls defining a horizontal upper surface 11 used as a cooking surface a hollow interior 12, and a well 13 for a large burner 14 extending into the interior of the casing 10. The well 13 has an upper annular rim 13*a* which is used to support a cooking vessel placed thereon. As illustrated in FIG. 2, the cooking vessel is preferably a wok 15 which has a rounded-bottom that rests upon the annular rim 13*a* so as to substantial close off the well 13 and prevent the flame 14*a* of the burner 14 from being exposed at the cooking surface 11. Confining the flame 14*a* in the well 13 greatly reduces the amount of heat lost to the outside, so that the heat is instead applied to the bottom of the cooking vessel. The cooking vessel may also be one having a flat bottom which is supported on the annular rim 13*a*. The stove also includes two small burners 15, 16 which may be of the conventional type positioned at the cooking surface 11 under a rigid grate 15*a*, 16*a* and above a shallow catch plate 15*b*, 16*b*.

The well 13 is preferably lined with a refractory material such as fire brick. For example, KS-4 firebrick, rated for 2500 degrees, supplied by A.P. Green, Industries, Missouri, may be used. The duct member 37 may be formed from sheet metal, and the inlet 37*a* may also be lined with refractory material.

The stove casing 10 includes a front panel 17, on which gas controls 18 for the burners are arranged, and a rear portion 19 which houses a gas feed pipe 20 having individual feeds 20*a*, 20*b*, 20*c* to the burners and a connector extending through a rear opening 21 in the stove casing 10 to allow connection to a gas utility source external to the stove. The gas controls 18 on the front panel 17 are connected to control valves to the burners 14, 15, 16 by mechanical linkages which are well known and therefore not shown in the drawings or described further herein.

Above the rear portion 19 of the stove casing 10, a duct casing 30 is arranged vertically upright and has a quadrangular form. The duct casing has a hot exhaust inlet 31 and a cool air inlet 32 formed in a lower panel 33, a warm air outlet 34 formed in an upper panel 35, and a plurality of baffles 36*a*, 36*b*, 36*c*, 36*d* forming a labyrinthine channel 36 from the inlets 31, 32 to the outlet 34. The cool air inlet 32 communicates with the interior 12 of the stove casing 10 and is supplied with cool air through rear opening 21 and front openings 22 formed at a lower side of the front panel 17. The hot air inlet 31 communicates with an opening in a duct member 37 which has its other opening communicating into the well 13 at a position adjacent the large burner 14.

Figure 3:
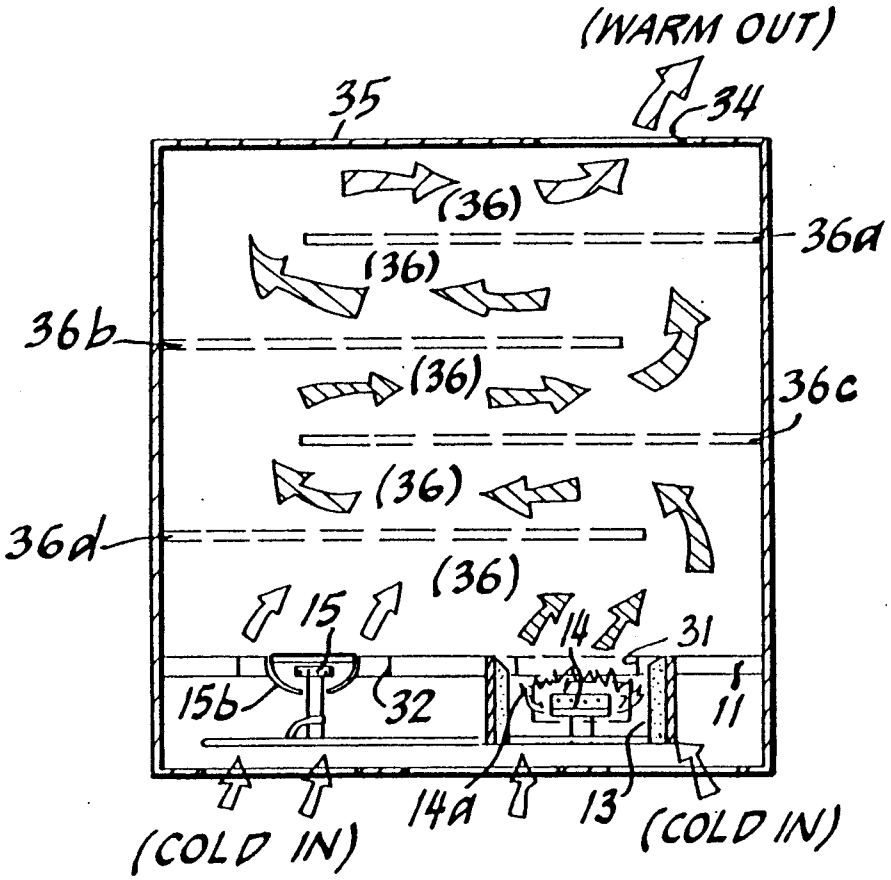
FIG. 3 is a front section view of the stove of FIG. 1 showing a section through the large burner and one of the small burners.

The operation of the stove is illustrated in FIGS. 1–3. The hot exhaust air heated by the flame 14*a* of the large burner 14 is trapped in the well 13 and becomes entrained by a convection draft of cold air entering the stove casing through openings 20, 22, and directed along the duct member 37 to the hot air inlet 31 of the duct casing 30. Cold air also enters the duct casing 30 through the cold air inlet 32. The hot and cold air are combined in the streams moving by convection along the labyrinthine channel 36 formed by the baffles 36*a*, 36*b*, 36*c*, 36*d*. The baffles have lengths shorter than the horizontal width of the duct casing 30, and are arranged alternatingly offset in opposite directions in ascending vertical order. The cold air is indicated by arrows that are white, hot air by arrows that are densely cross-hatched, and warm air by arrows that are sparesely cross-hatched.

As the hot and cold air streams move along the channel 36, they become mixed together, and the resulting temperature of the combined air streams is substantially reduced. For example, hot exhaust air of 500 to 600 degrees Fahrenheit in the vicinity of the burner becomes cooled down to about 80 to 100 degrees Fahrenheit at the outlet 34 in ambient air of about 70 degrees. The exiting air at the outlet 34 is thus cooled down enough so that it can be exhausted into the ambient air or handled by a small kitchen fan and vent. The stove thus provides the advantages of large-burner cooking suitable for use in the home. The positioning of the recessed burner 14 in the well 13, so that the flame 14*a* is not exposed to the outside, also ensures that the ambient air around the cooking surface will remain cool and comfortable without the necessity for forced-draft air handling equipment. The design of the stove also allows the air entrainment and mixing to be accomplished by natural convection, thereby eliminating any need for movement of air by forced draft. However, a small fan may be used to increase the volume of air movement if desired.

Figure 4:
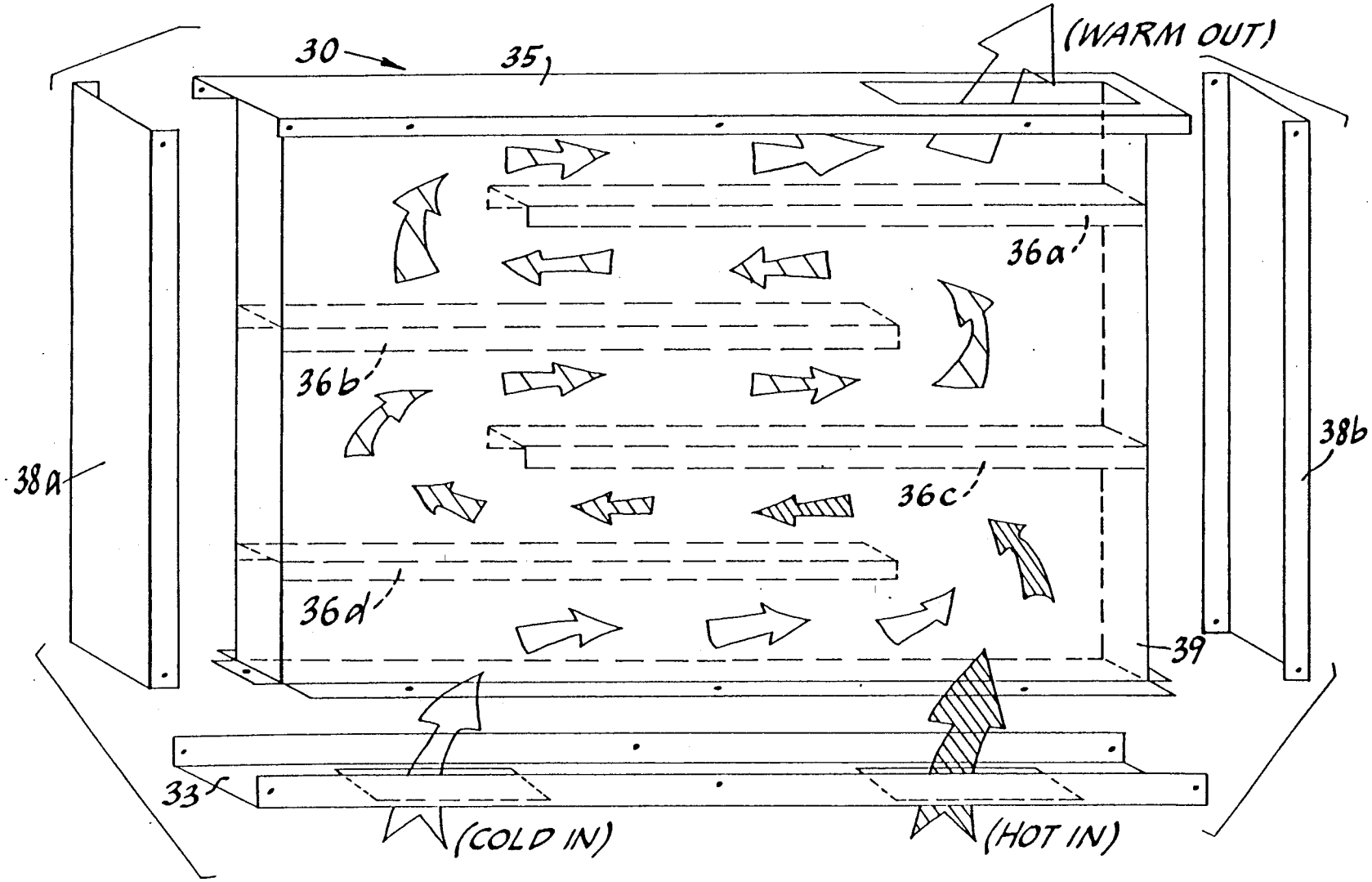
FIG. 4 is an exploded diagram illustrating the double wall construction of the duct casing.

In FIG. 4, the duct casing 30 is shown formed with a double wall construction of outer panels 33, 35, 38*a*, 38*b*, (facing and back panels not shown for simplicity) and an inner casing 39. The panels and casing may all be formed of sheet metal, preferably stainless steel. The hollow space between the outer panels and inner casing is filled with an insulative material to insulate the outer panels from the heat of the air streams moving through the inner casing. For example, Inswool TM -HP ceramic fiber blanket, made by A. P. Green Industries, Missouri, may be used. As a result the outer panels remain cool to the touch, thus enhancing its safety.

The stove casing and duct casing may be formed as an integral unit, or as separate modules that can be mounted together for installation. The assembled unit is a stove-top range unit that can be mounted on a conventional oven to form a combined oven/range unit. Alternatively, it may be sold as a range unit which can be installed over a storage cabinet.

Figure 5:
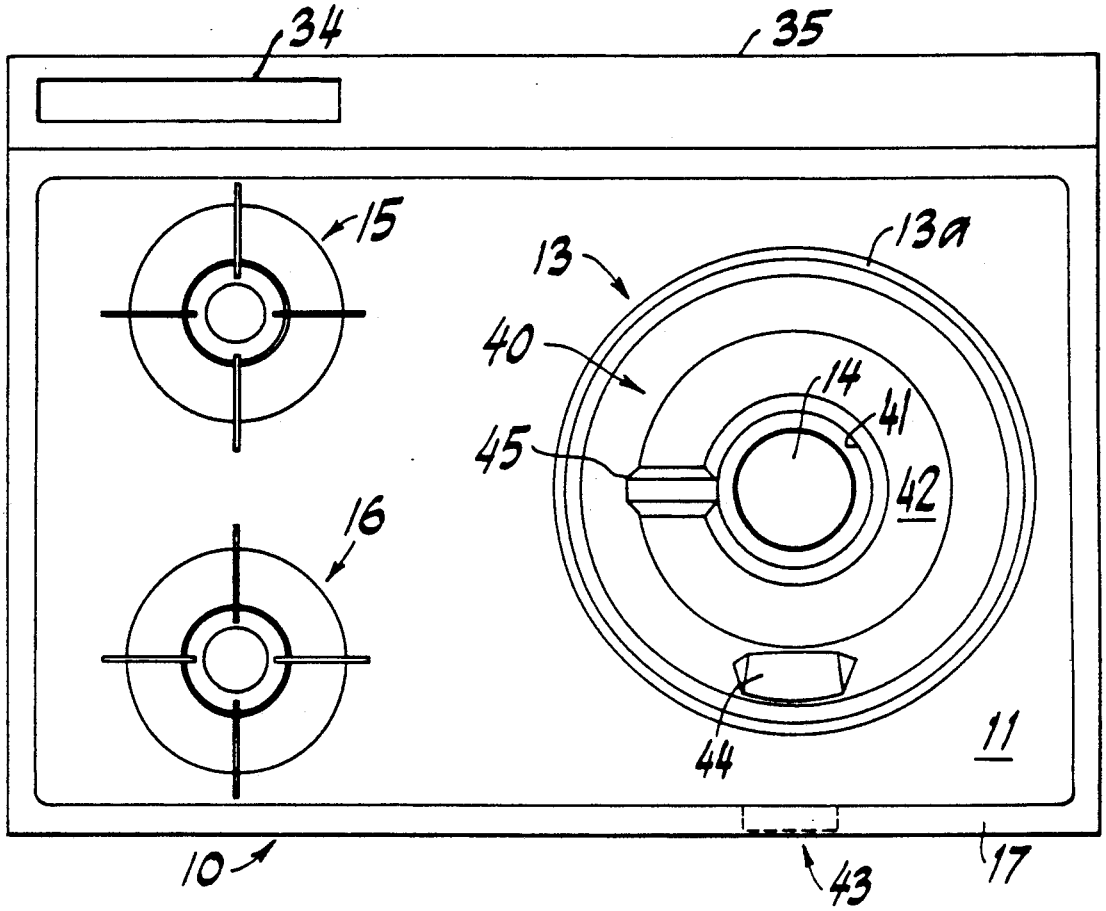
FIG. 5 is a plan view of the large burner stove showing a catch basin feature in its recessed burner well.
Figure 6:
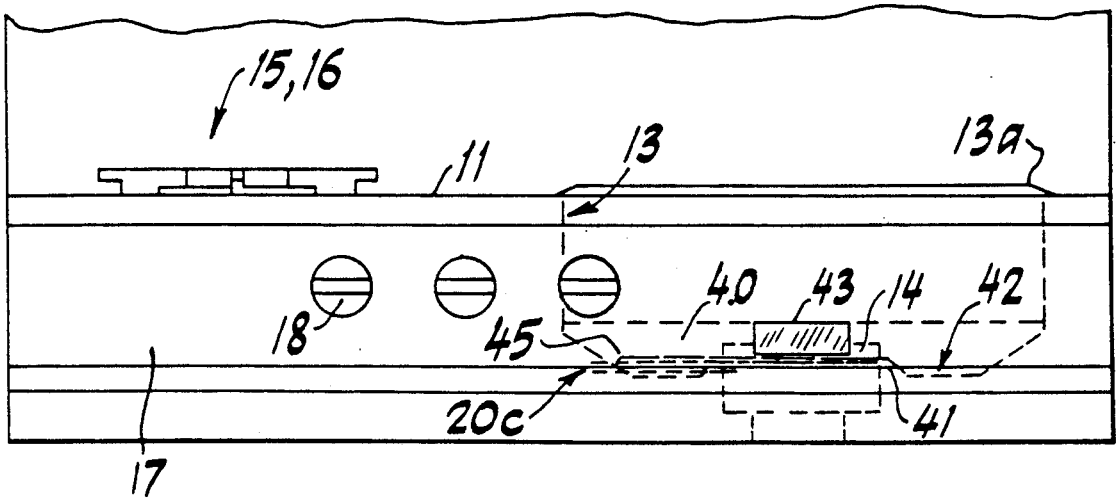
FIG. 6 is a front view of the stove showing the feature of a window for visually monitoring the burner flame.

In FIGS. 5 and 6, the wok is removed in order to show another feature of the large-burner stove in accordance with the invention consisting of a recessed catch basin member 40. The recessed catch basin member 40 has annular walls defining a central opening 41 for fitting around the burner 14 and a surrounding retention area 42 for catching any spillage or debris falling from the cooking vessel used over the burner. A window 43 is provided in the front panel 17 of the stove casing 10 to allow the flame of the burner 14 to be visually monitored through the front of the stove. A hooded opening 44 is formed through the walls of the catch basin member 40 in alignment with the window in order to leave open the line-of-sight (indicated by the dashed line and arrow in FIG. 5) from the window 43 to the burner 14. A raised ridge 45 is also formed at one side in order to allow passage of a pilot ignition unit to the burner 14. The catch basin member 40 can be readily removed for cleaning by lifting it up from the burner well 13.

Figure 7:
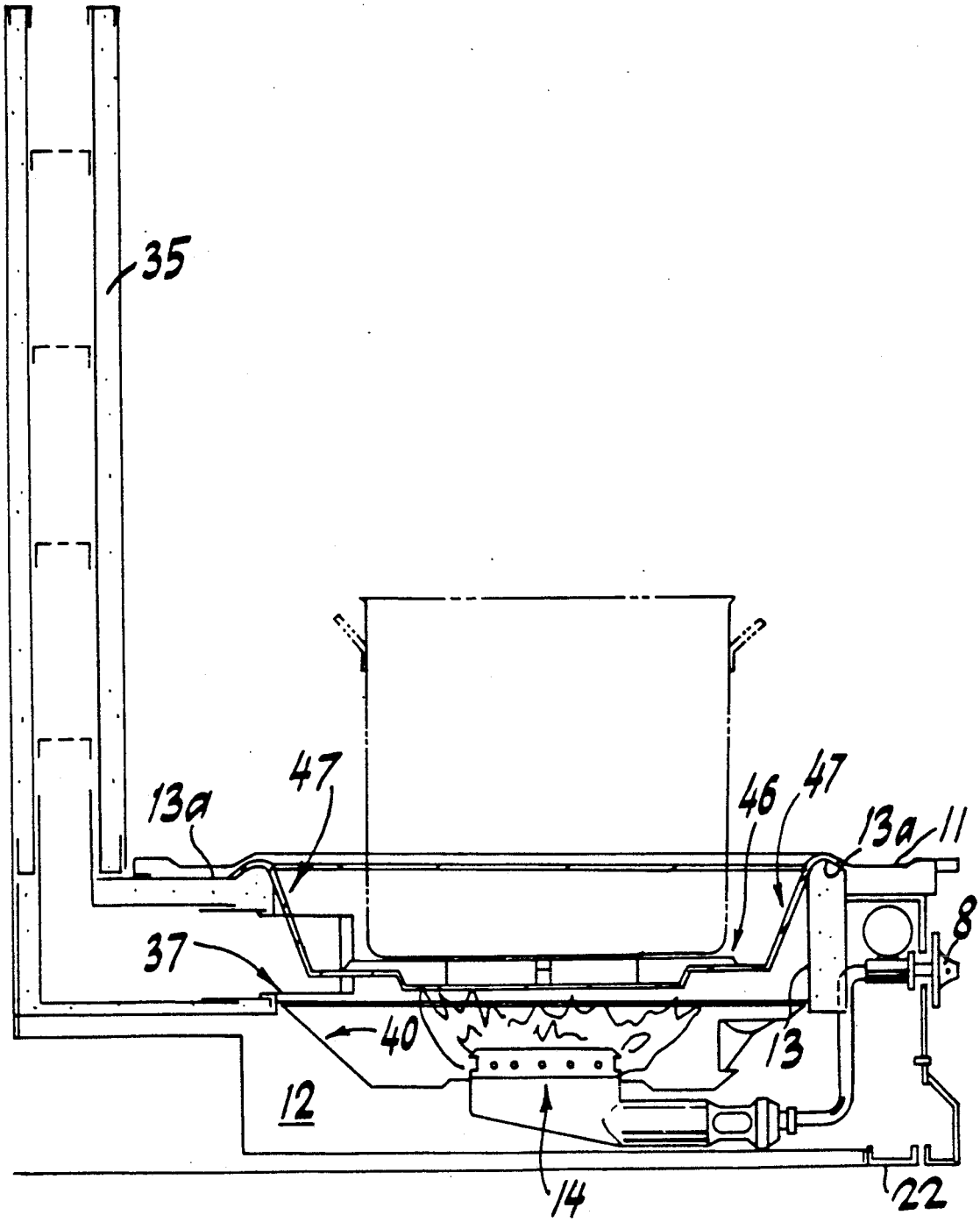
FIG. 7 is a side sectional view of the stove showing the catch basin structure and a recessed burner plate feature.

In FIG. 7, further features of the invention include a recessed burner plate 46 which is positionable in the burner well 13 over the burner 14 by suspension from a cradle which hangs from the annular rim 13*a*. The recessed burner plate allows large pots (as shown in the drawing) and other cooking vessels to be seated on the burner plate 46 when the wok 5 is removed from the stove. The high heat exhaust from the recessed burner 14 is also at least partially drawn into the interior duct 37 to be drafted and cooled down through the moderator chimney 35.

Figure 8:
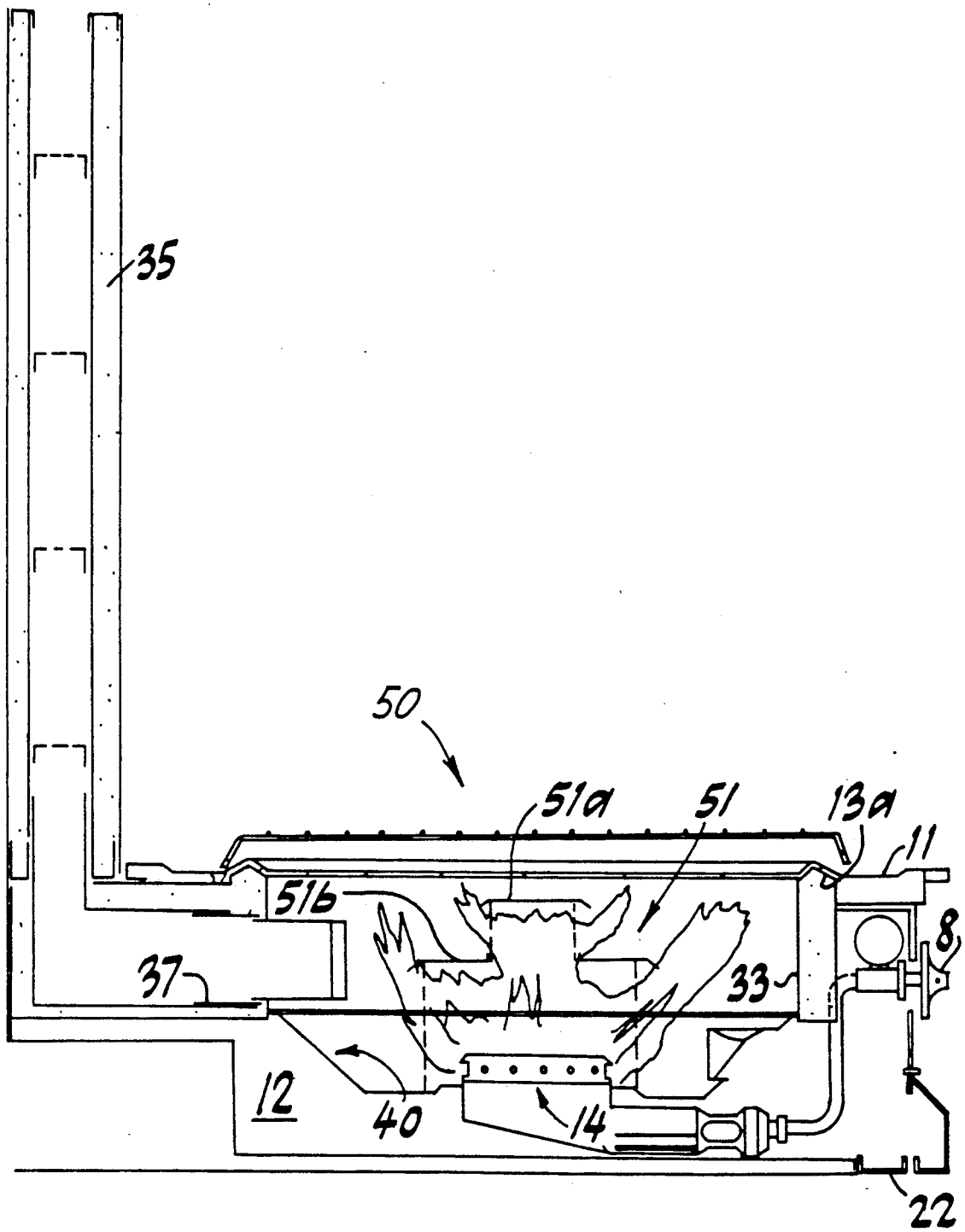
FIG. 8 is a side sectional view of the stove showing the catch basin structure and the further feature of a grill and deflector plate structure.

In FIG. 8, another feature includes a grill attachment which is positionable over the upper annular rim 13*a* at the horizontal upper surface 11 of the stove casing 10 for grilling, barbequeing, and other types of open-flame cooking. The grill 50 has a round shape with crossbars for holding the food to be grilled thereon. A deflector unit 51 is positionable below the grill 50 and over the burner 14 in order to deflect dripping grease, debris, or liquids away from the burner 14 into the retention area 42 of the catch basin member 40. The deflector unit has an upper deflector plate 51*a* vertically spaced from a lower deflector plate 51*b*. This tiered deflector plate structure allows the flame from the burner 14 to be spread out substantially evenly across the width of the grill 50. Instead of the open grill and deflector unit, a solid plate may be supported on the annular rim for pan frying or grilling or omelet and crepe cooking.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A stove suitable for large-burner cooking generating a high heat exhaust comprising:

an enclosed stove casing having walls defining a horizontal upper surface used as a cooking surface and a hollow interior;

a burner well extending into the interior of said stove casing and having an upper annular rim at said horizontal upper surface, said annular rim defining a support for a cooking vessel;

a burner recessed at an interior position in said well in the interior of said casing which provides a flame to a bottom portion of a cooking vessel used thereon;

ducting means including a first duct member positioned at a rear portion of said stove casing remote from said burner well and a second duct member having an opening located adjacent said interior position of said well and another opening communicating into said first duct member for conveying high heat exhaust from said burner into said first duct member at said rear portion of said stove casing; and a catch basin member positionable in the interior of said burner well having annular walls defining a central opening for fitting around said burner and a surrounding retention area for catching any spillage or debris falling from a cooking vessel used thereon.

2. A stove according to claim 1, wherein said stove casing has a window formed in a front panel thereof at a position in alignment with said burner in the interior of said burner well for allowing the stove user to visually check the burner flame by viewing through said window.

3. A stove according to claim 2, wherein said catch basin member has an opening formed through a front portion of its walls aligned with said window in order to leave a line-of-sight from said window to said burner.

4. A stove according to claim 1, further comprising a recessed burner plate which is positionable in the interior of said burner well over said burner for allowing cooking with a cooking vessel seated thereon.

5. A stove according to claim 4, wherein said recessed burner plate is positioned over said burner by suspension from a cradle which hangs from said upper annular rim at said horizontal upper surface.

6. A stove according to claim 1, further comprising a grill which is positionable over said upper annular rim for allowing open-flame cooking.

7. A stove according to claim 6, further comprising a deflector unit positionable in the interior of said burner well below said grill and over said burner for open-flame cooking.

8. A stove according to claim 1, wherein said annular rim of said burner well is dimensioned to support a wok or other rounded-bottom cooking vessel.

9. A stove according to claim 1, wherein said burner well has vertically oriented cylindrical walls which are lined with a refractory material to insulate the stove from the heat from said burner in said well.

10. A stove according to claim 9, wherein the opening of said second duct member in said burner well is formed through said cylindrical walls and liner material.

11. A stove according to claim 1, wherein said first duct member comprises an enclosed duct casing oriented vertically and having walls defining a hollow interior, an inlet communicating with said second duct member for receiving high heat exhaust at a lower portion of said duct casing, an outlet for reduced-temperature exhaust at an upper portion thereof, a plurality of generally horizontal baffles forming a labyrinthine channel through the interior of said first duct member between said inlet and said outlet, and means for generating a draft of ambient air into said labyrinthine channel for mixing with said high heat exhaust and reducing its temperature such that a reduced-temperature exhaust is output at said outlet of said first duct member.

12. A stove according to claim 11, wherein said duct casing is a quadrangularly shaped member supported upright on the rear portion of said stove casing.

13. A stove according to claim 11, wherein said baffles in the duct casing are spaced vertically from each other and have offset horizontal lengths which are alternated in opposite directions to form said labyrinthine channel.

14. A stove according to claim 11, wherein said duct casing has a double wall construction lined with insulative material to insulate the stove from the heat of the exhaust in the duct casing.

15. A stove according to claim 11, wherein said ambient air draft is generated by a second inlet in the bottom portion of said stove casing which is supplied with ambient air through openings formed in said stove casing.

16. A stove according to claim 11, wherein said duct casing and said stove casing are formed as separate modules that are assembled together for installation.

17. A stove according to claim 11, wherein said duct casing and stove casing are installed as a stove top unit over a lower oven or storage unit.

* * * * *